United States Patent [19]

Synofzik

[11] Patent Number: 4,856,432

[45] Date of Patent: Aug. 15, 1989

[54] SPIN STABILIZED CARRIER PROJECTILE INCLUDING AT LEAST TWO SUBMUNITION PROJECTILES

[75] Inventor: Reinhard Synofzik, Jüchen, Fed. Rep. of Germany

[73] Assignee: Rheinmetall GmbH, Düsseldorf, Fed. Rep. of Germany

[21] Appl. No.: 135,508

[22] Filed: Dec. 16, 1987

[30] Foreign Application Priority Data

Dec. 18, 1986 [DE] Fed. Rep. of Germany ..... 3643293

[51] Int. Cl.[4] ..... F42B 13/50; F42B 13/32

[52] U.S. Cl. ..... 102/489; 102/386; 102/501; 244/3.3

[58] Field of Search ..... 102/340, 342, 351, 357, 102/386, 387, 388, 393, 400, 354, 476, 501, 517, 489; 244/113, 138, 142, 3.1, 3.24, 3.27, 3.3

[56] References Cited

U.S. PATENT DOCUMENTS

| | | | |
|---|---|---|---|
| 1,011,002 | 12/1911 | Wunsche | 102/340 |
| 4,129,078 | 12/1978 | Schneider, Jr. et al. | 102/505 |
| 4,215,836 | 5/1980 | Zacharin | 102/386 |
| 4,565,341 | 1/1986 | Zacharin | 244/138 |
| 4,753,171 | 6/1988 | Stessen . | |

FOREIGN PATENT DOCUMENTS

| | | | |
|---|---|---|---|
| 0195854 | 12/1985 | European Pat. Off. . | |
| 3127071 | 1/1983 | Fed. Rep. of Germany . | |
| 3608107 | 10/1987 | Fed. Rep. of Germany . | |
| 2187825 | 9/1987 | United Kingdom | 102/387 |

OTHER PUBLICATIONS

"A New Rotating Parachute Design Having High Performance", by Pepper, Jr. J Space Craft, Mar.-Apr. 86, vol. 23, No. 2, pp. 222-224.

*Primary Examiner*—Harold J. Tudor
*Attorney, Agent, or Firm*—Spencer & Frank

[57] ABSTRACT

A spin stabilized carrier projectile having a longitudinal axis comprising: a projectile body; and at least two submunition bodies disposed in, and ejectable from, the projectile body, the submunition bodies being spaced along the axis, each submunition body having a folded, expandable deceleration means for reducing the velocity and spin of the submunition body upon ejection from the projectile body, the deceleration means including a sheet of material for producing air resistance, and the deceleration means having different dimensions for respectively different submunition bodies so that each respective submunition body is decelerated less than the submunition body disposed behind the respective submunition body.

5 Claims, 2 Drawing Sheets

SPIN STABILIZED CARRIER PROJECTILE INCLUDING AT LEAST TWO SUBMUNITION PROJECTILES

BACKGROUND OF THE INVENTION

1. Field of the Invention

The present invention relates to a spin stabilized carrier projectile including at least two submunition projectiles.

2. Description of the Prior Art

Carrier projectiles are disclosed, for example, in Flume, "Artilleriemunition: Bessere Wirkung im Ziel" [Artillery Ammunition - Better Effect On Target], in Wehrtechnik [Defense Technology], 1985, Volume 10, pages 112–120. In this example the carrier projectile is shot with the aid of a cannon. The carrier projectile includes two or more target seeking submunition bodies which are ejected from the projectile at a given point in time. After ejection the submunition bodies initially decelerate and experience reduction in spin. Customarily, the reduction in velocity is effected with the aid of a parachute and the spin is reduced with the aid of so-called spin fins. As soon as the velocity and spin of the submunition bodies have been reduced to preselected values, the spin fins and the parachute required to reduce velocity are ejected. Then another parachute opens and the submunition body floats to the ground while being allowed to perform the rotating movement for the purpose of scanning the target area.

As soon as a target has been detected by the submunition body an active portion of the body is ignited so that a projectile forming charge is produced which then hits the target. The primary drawback in this prior art ammunition is that the subminition bodies fly into the target area in close proximity to one another and therefore they hit one certain target while other targets in the target region are not hit.

It has been proposed to effect reduction of spin and deceleration of the submunition bodies by means of a woven brake disk and this brake disk will be described in detail below in connection with the description of the drawing figures.

SUMMARY OF THE INVENTION

It is an object of the present invention to further develop a spin stabilized carrier projectile so that the submunition bodies are distributed over the largest possible target area in the given target region.

The above and other objects are accomplished by the invention in which a spin stabilized carrier projectile having a longitudinal axis comprises: a projectile body; and at least two submunition bodies disposed in, and ejectable from, the projectile body, the submunition bodies being spaced along the axis, each submunition body having a folded, expandable deceleration means for reducing the velocity and spin of the submunition body upon ejection from the projectile body, the deceleration means including a sheet of material for producing air resistance, and the deceleration means having different dimensions for respectively different submunition bodies so that each respective submunition body is decelerated less than the submunition body disposed behind the respective submunition body.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENTS

Figure 1:
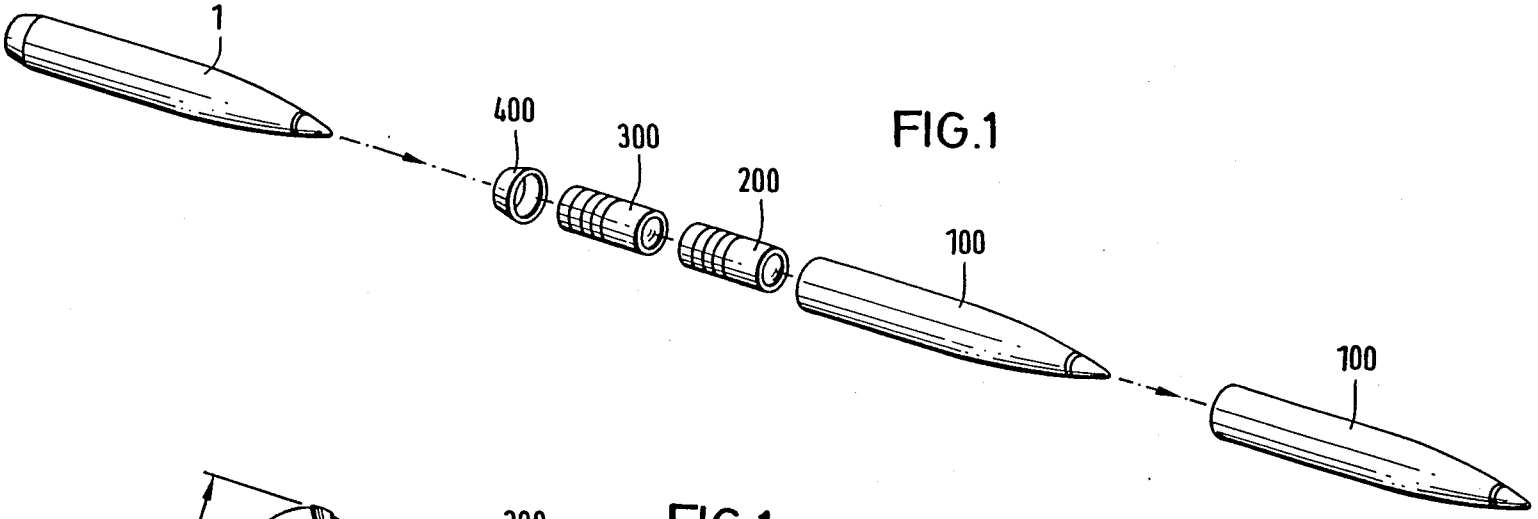
FIG. 1 shows schematically the time sequence of the process of ejecting two submunition bodies equipped with the deceleration elements according to the invention.
Figure 1A:
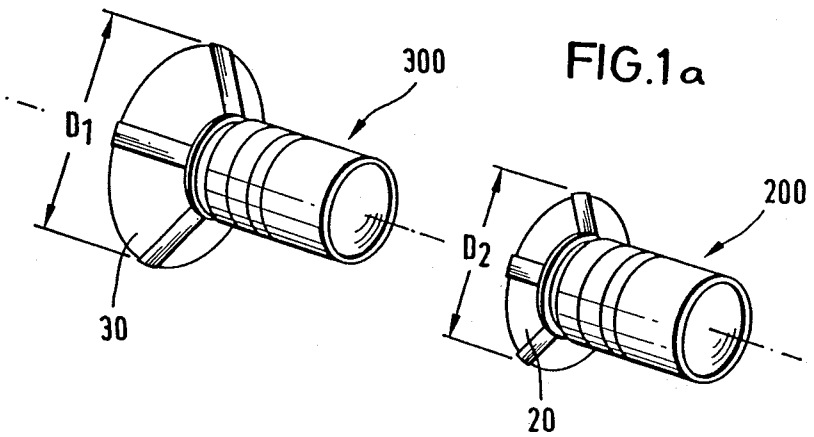
FIG. 1*a* shows a detail of FIG. 1.

FIG. 1 discloses a projectile 1 which has been fired by a gun (not shown), for example. This projectile 1 includes a projectile body 100, a projectile bottom 400, and target seeking submunition bodies 200 and 300 which are ejected from projectile 1 after a predetermined time. The submunition bodies are ejected in a known manner. After this ejection process the projectile body 100, the submunition bodies 200 and 300 and the bottom 400 of projectile 1 initially fly one behind the other. Unfolding of deceleration elements 20 and 30, shown in FIG. 1*a*, causes the velocity of the submunition bodies 200, 300 to be reduced and thus the trajectory of submunition bodies 200, 300 becomes different than the trajectory of projectile body 100.

Deceleration elements 20 and 30 produce both a reduction in velocity of the submunition body as well as a reduction in spin. As soon as both values have dropped to a predetermined level, the deceleration elements 20, 30 are ejected from the submunition bodies (not shown).

According to the invention the deceleration elements 20 and 30 have different dimensions, specifically different outer diameters D1 and D2 and thus they have differences in resistance to air flow. These differences in resistance cause submunition bodies 200 and 300 to become separated. By properly selecting the diameters of deceleration elements 20 and 30 it is thus possible to distribute the submunition bodies over a relatively large target area in a given target region.

Further deceleration of the submunition bodies may be effected by other means including unfolding a parachute, for example, and the rotating movement of these bodies can be used to scan the target area (In this connection see, Flume, "Artilleriemunition: Bessere Wirkung im Ziel" [Artillery Ammunition - Better Effect On Target], in Wehrtechnik [Defense Technology] 1985, No. 10, pages 112 et seq.).

Figure 2:
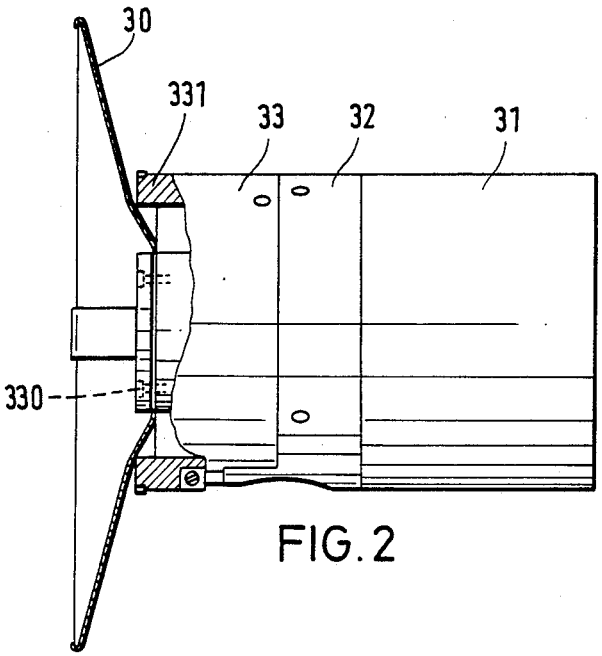
FIG. 2 is a side view of a submunition body according to the invention.

FIG. 2 is a side view of submunition body 300 with a sectional view in the region of deceleration element or brake disc 30. In addition to deceleration element 30, submunition body 300 includes the actual active body 31 which contains a shaped charge, for example; a housing 32, which may contain signal processing means and a pivotal antenna (not shown); and a removable supporting structure 33 to which brake disc 30 is fastened by securing means of, for example screws 330. An annular projection 331 encloses the packing area for deceleration element 30.

Figure 3:
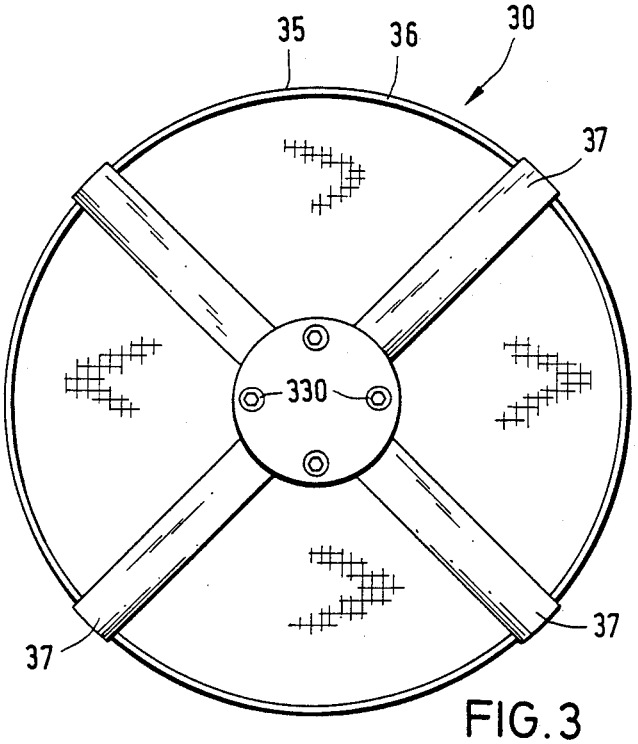
FIG. 3 is a plan view of a deceleration element according to FIG. 2 of the invention.

FIG. 3 is a plan view from the rear of the brake disc according to the invention as shown in FIG. 2. An edge reinforcement 36 serves the purpose of preventing the edge of the brake disk from tearing as a result of the rapid rotation of projectile 300. However, the fact that edge reinforcement 36 maintains a larger mass density in edge region 35 than in the remaining region of the woven brake disk is an even more significant purpose for edge reinforcement 36.

Further stability is imparted to woven brake disk 30 by additional strips of webbing 37. These strips of webbing 37 are preferably arranged in a crosswise pattern. This considerably increases the strength of the entire deceleration element.

A polyamide or a plastic sheet of sufficient strength has been found to be particularly useful as material for the woven brake disk, for the strips of webbing and also for the edge reinforcement.

The rotation of the projectile causes the edge region of the woven brake disk to be propelled outwardly so that the brake disk is unfolded very quickly, as a result of the rotation.

It will be understood that the above description of the present invention is susceptible to various modifications, changes and adaptations, and the same are intended to be comprehended within the meaning and range of equivalents of the appended claims.

What is claimed is:

1. A spin stabilized carrier projectile having a longitudinal axis comprising:

a projectile body; and at least two submunition bodies disposed in, and ejectable from, said projectile body, said submunition bodies being spaced along said axis, each said submunition body having a folded, expandable disk-shaped deceleration means for reducing the velocity and spin of said submunition body upon ejection from said projectile body, said deceleration disk-shaped means including a sheet of material for producing air resistance, and said disk-shaped deceleration means having different dimensions for respectively different submunition bodies so that each respective submunition body is decelerated less than said submunition body disposed behind the respective submunition body.

2. A spin stabilized carrier projectile as defined in claim 1, wherein said disk-shaped deceleration means have a circular configuration.

3. A spin stabilized carrier projectile as defined in claim 1, wherein said sheet of material is composed of a woven fabric.

4. A spin stabilized carrier projectile as defined in claim 1, wherein said sheet of material is composed of plastic sheeting.

5. A spin stabilized carrier projectile as defined in claim 1, wherein each said submunition body has a rear end and said disk-shaped deceleration means is disposed at said rear end.

* * * * *